US010105580B2

(12) United States Patent
Shimahara et al.

(10) Patent No.: US 10,105,580 B2
(45) **Date of Patent: *Oct. 23, 2018**

(54) IRON TYPE GOLF CLUB SET

(71) Applicant: SUMITOMO RUBBER INDUSTRIES, LTD., Kobe-shi (JP)

(72) Inventors: Yuki Shimahara, Kobe (JP); Daisuke Kohno, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/455,973

(22) Filed: Mar. 10, 2017

(65) Prior Publication Data

US 2017/0259133 A1 Sep. 14, 2017

(30) Foreign Application Priority Data

Mar. 11, 2016 (JP) ..... 2016-048009

(51) Int. Cl.
*A63B 53/04* (2015.01)
*A63B 53/00* (2015.01)

(52) U.S. Cl.
CPC ..... *A63B 53/047* (2013.01); *A63B 2053/005* (2013.01); *A63B 2053/0408* (2013.01); *A63B 2053/0433* (2013.01)

(58) Field of Classification Search
CPC ..... A63B 53/047; A63B 53/00; A63B 53/04; A63B 2053/0433; A63B 2053/005; A63B 2053/0408
See application file for complete search history.

(56) References Cited

U.S. PATENT DOCUMENTS 5,263,718 A * 11/1993 Salheim ..... A63B 53/04 473/291
5,312,105 A * 5/1994 Cleveland ..... A63B 53/00 473/350
5,356,138 A * 10/1994 Chen ..... A63B 53/04 473/291
5,429,353 A * 7/1995 Hoeflich ..... A63B 53/04 473/291
5,547,426 A * 8/1996 Wood ..... A63B 53/04 473/290
5,595,552 A * 1/1997 Wright ..... A63B 53/04 473/332

(Continued)

FOREIGN PATENT DOCUMENTS

JP 6-96049 B2 11/1994
JP 3095052 B2 10/2000

*Primary Examiner* — John E Simms, Jr.

(74) *Attorney, Agent, or Firm* — Birch, Stewart, Kolasch & Birch, LLP

(57) ABSTRACT

A set 2 includes two or more iron type golf clubs 4 having loft angles different from each other. Each club 4 includes a shaft sf, a head hd, and a grip gp. The head hd includes a top surface 10, a sole surface 12, and a face surface 14 having a face line gv. The sole surface 12 includes a leading edge E1 and a trailing edge E2. In a planar view of the sole surface 12, the trailing edge E2 is curved so as to project toward a face side. A sole width WSc at a middle position of the face line gv is increased as the loft angle is increased.

8 Claims, 20 Drawing Sheets

(56) References Cited

U.S. PATENT DOCUMENTS

| | | | | | |
|---|---|---|---|---|---|
| 5,813,919 | A * | 9/1998 | Best | A63B 53/04 | 473/290 |
| 5,916,041 | A * | 6/1999 | Antonious | A63B 53/04 | 473/328 |
| 6,106,410 | A * | 8/2000 | Glod | A63B 53/04 | 473/290 |
| 6,290,607 | B1 * | 9/2001 | Gilbert | A63B 53/04 | 473/291 |
| 6,471,601 | B1 * | 10/2002 | McCabe | A63B 53/047 | 473/290 |
| 2010/0041493 | A1 * | 2/2010 | Clausen | A63B 53/047 | 473/291 |

* cited by examiner

IRON TYPE GOLF CLUB SET

The present application claims priority on Patent Application No. 2016-048009 filed in JAPAN on Mar. 11, 2016, the entire contents of which are hereby incorporated by reference.

BACKGROUND OF THE INVENTION

Field of the Invention

The present invention relates to an iron type golf club set.

Description of the Related Art

Proposals in relation to a sole shape have been made in an iron type golf club set. In Japanese Patent No. H6-96049, a golf club set is disclosed, in which the curvature radius of a sole is decreased from a long iron club to a short iron club. Japanese Patent No. 3095052 discloses a golf club set including a head including a toe side guide surface and a heel side guide surface on a sole. The toe side guide surface and the heel side guide surface are inclined obliquely upward from a back side rear edge toward a face side front edge. In the set, the inclination is increased from a long iron to a short iron via a middle iron.

SUMMARY OF THE INVENTION

In an iron type golf club set (iron set), iron numbers have different roles. An iron club is most commonly used when hitting a golf ball directly placed on grass, and is used in various situations where the inclinations of a ground, or the like are different. Furthermore, for example, high-level golf players tend to obtain desired hit balls by various swings, and iron clubs having excellent operativity are required. Therefore, various performances are required for the iron numbers in the iron set.

As a result of the extensive studies, the present inventors have found that performances required for iron numbers of the iron set are more complicated than performances considered hitherto.

The present disclosure shows an iron type golf club set which can satisfy various performances required for iron numbers in a set.

In one aspect, an iron type golf club set includes two or more iron type golf clubs having loft angles different from each other. Each of the golf clubs includes a shaft, a head attached to a tip part of the shaft, and a grip attached to a rear end part of the shaft. The head includes a sole surface and a face surface having a face line. The sole surface includes a leading edge and a trailing edge. The trailing edge is curved so as to project toward a face side in a planar view of the sole surface. A sole width WSc at a middle position of the face line is increased as the loft angle is increased.

In another aspect, a sole width WSt at a toe reference position is increased as the loft angle is increased. Preferably, a sole width WSh at a heel reference position is increased as the loft angle is increased.

In another aspect, a difference (WSt−WSc) is decreased as the loft angle is increased. Preferably, a difference (WSh−WSc) is decreased as the loft angle is increased.

In another aspect, a curvature radius of the trailing edge in the planar view is increased as the loft angle is increased.

In another aspect, the sole surface includes a ridgeline extending from a toe side toward a heel side, a leading surface extending between the ridgeline and the leading edge, and a trailing surface extending between the ridgeline and the trailing edge. In another aspect, the leading surface is inclined upward toward the face side. In another aspect, the trailing surface is inclined upward toward a back side.

DESCRIPTION OF THE PREFERRED EMBODIMENTS

Hereinafter, the present disclosure will be described in detail according to the embodiments with appropriate references to the accompanying drawings.

[Definitions of Terms]

The definitions of terms in the present application are as follows.

[Reference State]

Figure 20:
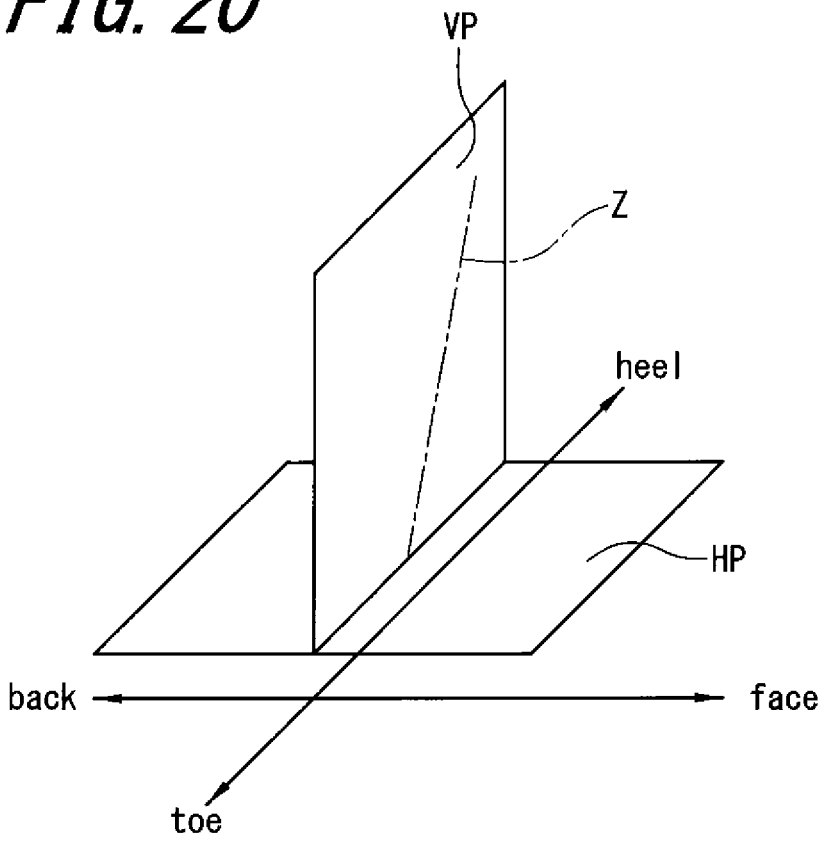
FIG. 20 is a perspective view showing a horizontal plane HP and a reference perpendicular plane VP in a reference state.

The reference state is a state where a head is placed on a horizontal plane HP in a state where the horizontal plane HP and a face line gv are parallel to each other. In the reference state, a center axis line Z (shaft axis line Z) of a shaft hole of the head is provided in a reference perpendicular plane VP (see FIG. 20). The reference perpendicular plane VP is a plane perpendicular to the horizontal plane HP. In the reference state, the face line gv is parallel to the horizontal plane HP, and parallel to the reference perpendicular plane VP.

[Toe-Heel Direction]

In the head of the reference state, the direction of an intersectional line between the reference perpendicular plane VP and the horizontal plane HP is the toe-heel direction. The toe-heel direction is parallel to the face line gv.

[Face-Back Direction]

A direction perpendicular to the toe-heel direction and parallel to the horizontal plane HP is the face-back direction. The face-back direction is also a front-rear direction. A face side is also referred to as a front side.

[Up-Down Direction]

A direction perpendicular to the toe-heel direction and perpendicular to the face-back direction is the up-down direction.

[Middle Position of Face Line]

The middle position of a longest face line gv1 in the toe-heel direction is a middle position Pc of the face line (see FIG. 2 to be described later). The middle position Pc is a position in the toe-heel direction. When the plurality of longest face lines gv1 are present, the middle position Pc is determined based on the lowermost longest face line gv1.

[Toe Reference Position]

The position of a toe side end of the longest face line gv1 is a toe reference position Pt (see FIG. 2 to be described later). The toe reference position Pt is a position in the toe-heel direction. When the plurality of longest face lines gv1 are present, the toe reference position Pt is determined based on the lowermost longest face line gv1.

[Heel Reference Position]

The position of a heel side end of the longest face line gv1 is a heel reference position Ph (see FIG. 2 to be described later). The heel reference position Ph is a position in the toe-heel direction. When the plurality of longest face lines gv1 are present, the heel reference position Ph is determined based on the lowermost longest face line gv1.

[Leading Edge]

A point positioned on a frontmost side (face side) in a section of the head taken along the face-back direction is the leading edge.

[Trailing Edge]

The trailing edge is a back side edge of a sole surface. When the backside edge of the sole surface cannot be confirmed due to roundness or the like, the trailing edge can be determined as follows. When the curvature radius of points of the trailing surface are sequentially calculated toward rear in the section taken along the face-back direction, a point at which the curvature radius is first set to be equal to or less than 5 mm is the trailing edge.

[Sole Width]

A distance between the leading edge and the trailing edge is the sole width. The sole width is a distance in the face-back direction.

Figure 1:
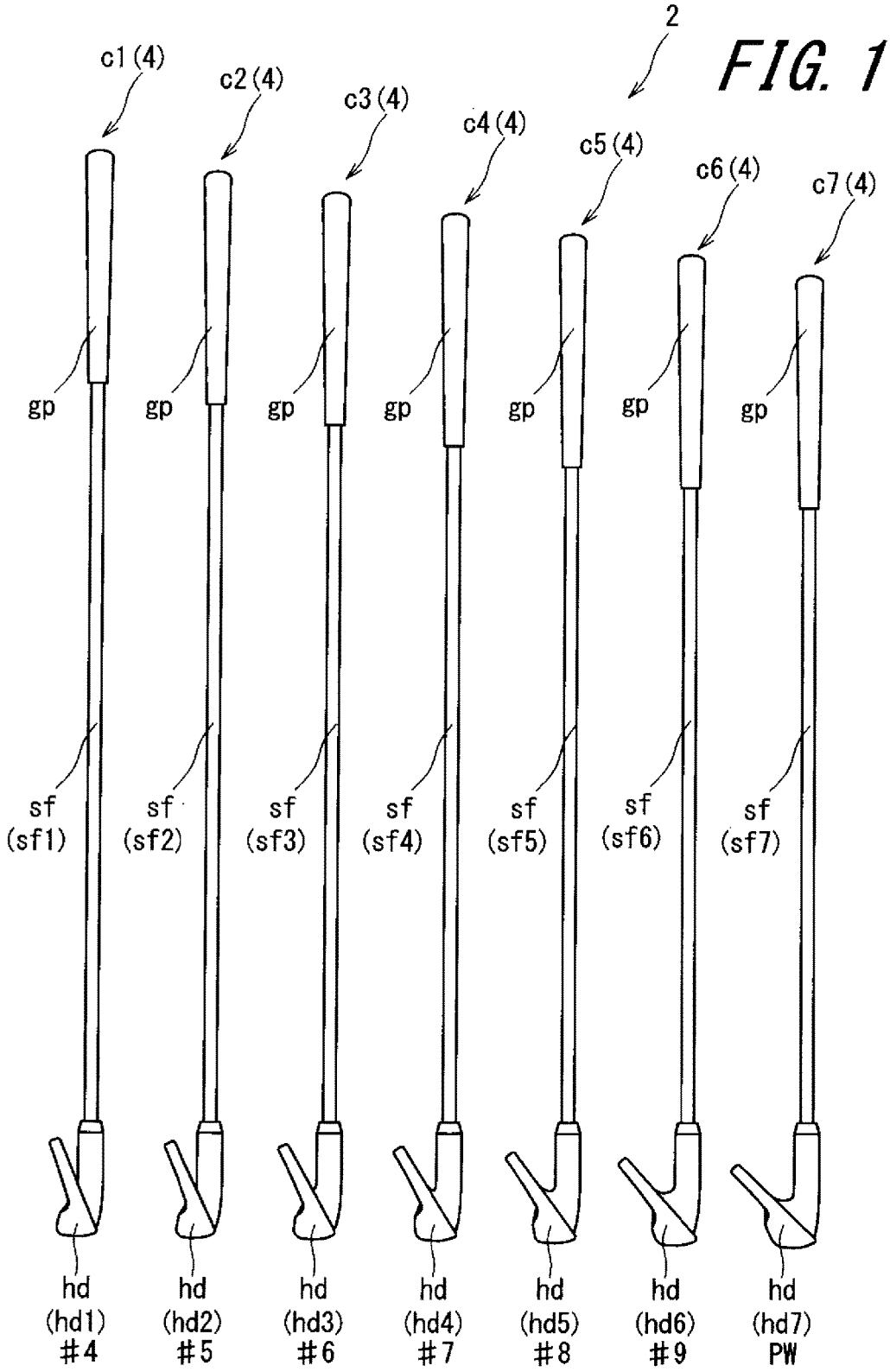
FIG. 1 shows an iron type golf club set according to a first embodiment.

FIG. 1 shows an iron type golf club set 2 according to one embodiment. In the present application, an iron type golf club set is also referred to as a golf club set, a club set, an iron set, or a set. The loft angle of an iron type golf club is usually 15 degrees or greater but 70 degrees or less. Unless otherwise described, in the present application, the loft angle means a real loft angle. The real loft angle is a loft angle with respect to the shaft axis line Z.

The set 2 includes two or more iron type golf clubs 4 having loft angles different from each other. The set 2 includes two or more iron type golf clubs 4 having club lengths different from each other. The set 2 includes two or more iron type golf clubs 4 having club lengths and loft angles different from each other. In the set 2, the loft angle is increased as the club length is decreased.

The number of the clubs in the club set is equal to or greater than 2. In the set 2, the number of the clubs is 7. As long as the number of the clubs of the set 2 is equal to or greater than 2, the number of the clubs of the set 2 is not limited. From the viewpoint of emphasizing the effect of the present disclosure for the set, the number of the clubs of the set 2 is preferably equal to or greater than 3, more preferably equal to or greater than 4, still more preferably equal to or greater than 5, and yet still more preferably equal to or greater than 6. In the golf rule, the number of the clubs capable of being used during play is limited. From this viewpoint, the number of the clubs of the set 2 is preferably equal to or less than 11, more preferably equal to or less than 10, and still more preferably equal to or less than 9.

Each of the golf clubs 4 includes a shaft sf, a head hd, and a grip gp. The head hd is attached to a tip part of the shaft sf. The grip gp is attached to a rear end part of the shaft sf.

The set 2 includes golf clubs c1 to c7. The golf club c1 includes a shaft sf1, a head hd1, and a grip gp. The golf club c2 includes a shaft sf2, a head hd2, and a grip gp. The golf club c3 includes a shaft sf3, a head hd3, and a grip gp. The golf club c4 includes a shaft sf4, a head hd4, and a grip gp. The golf club c5 includes a shaft sf5, a head hd5, and a grip gp. The golf club c6 includes a shaft sf6, a head hd6, and a grip gp. The golf club c7 includes a shaft sf7, a head hd7, and a grip gp. The length of the shaft sf is decreased as the loft angle is increased.

The set 2 includes the golf club c1, the golf club c2, the golf club c3, the golf club c4, the golf club c5, the golf club c6, and the golf club c7 in a descending order of a club length from the club having the longest club length. The loft angle is increased as the club length is decreased. In some iron numbers (for example, wedges), the loft angles may be different, and the club lengths may be the same.

Although not illustrated, in the set 2, a lie angle is increased as the club length is decreased.

In the set 2, the iron numbers of the clubs are as follows. The golf club c1 is a 4-iron; the golf club c2 is a 5-iron; the golf club c3 is a 6-iron; the golf club c4 is a 7-iron; the golf club c5 is an 8-iron; the golf club c6 is a 9-iron; and the golf club c7 is a pitching wedge (PW). In the present disclosure, the iron number of the golf club 4 included in the set 2 is not limited.

In the set 2, the club length is decreased as the iron number is increased. The loft angle is increased as the iron number is increased. A difference between the loft angles of the adjacent iron numbers is usually 2 degrees or greater but 6 degrees or less.

In light of the effect (to be described later) of the present disclosure for the set, the set 2 preferably includes at least two selected from the group consisting of the following first club, second club, and third club. More preferably, the set 2 includes the following first club, second club, and third club:

[first club]: a club having a loft angle of 22 degrees or greater but less than 28.5 degrees, and a club length of 37.25 inches or greater but 38.5 inches or less;

[second club]: a club having a loft angle of 28.5 degrees or greater but less than 36.5 degrees, and a club length of 36.25 inches or greater but less than 37.25 inches; and

[third club]: a club having a loft angle of 36.5 degrees or greater but 47 degrees or less, and a club length of 35 inches or greater but less than 36.25 inches.

The set 2 may include the following fourth club:

[fourth club]: a club having a loft angle of greater than 47 degrees but 70 degrees or less, and a club length of 35 inches or greater but 36 inches or less.

Next, the head hd will be described. Hereinafter, the 4-iron, the 7-iron, and the pitching wedge will be exemplarily illustrated. The three iron numbers are only examples to the last.

Figure 2:
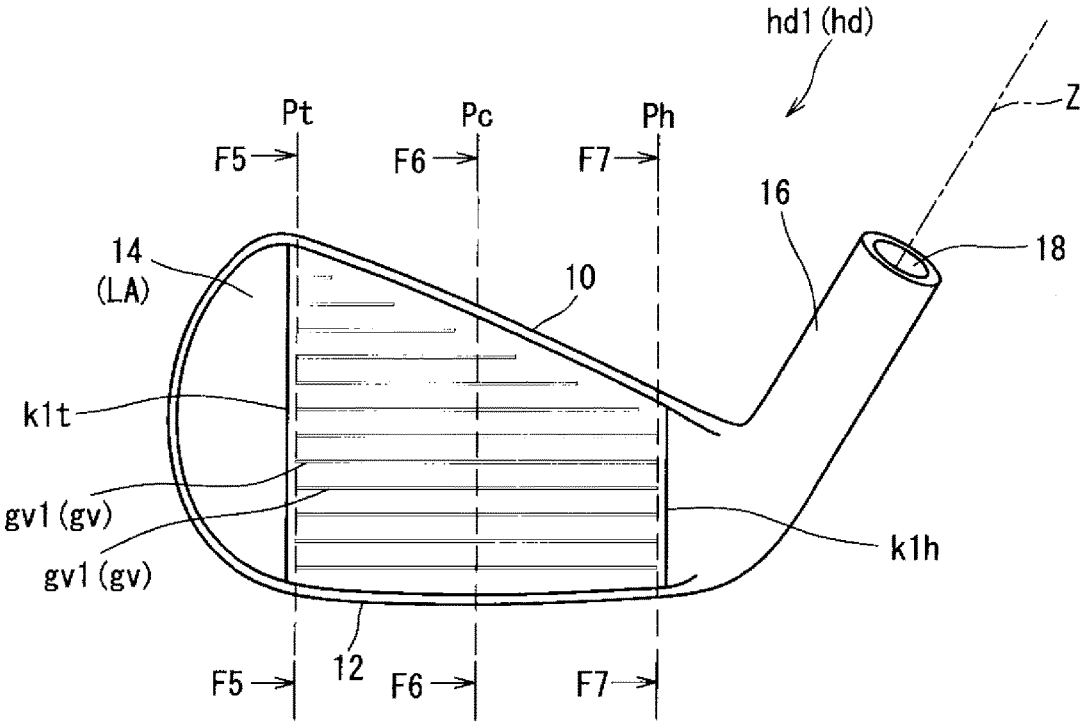
FIG. 2 is a front view of a head (4-iron) included in the set of FIG. 1, as viewed from the front of a face.
Figure 3:
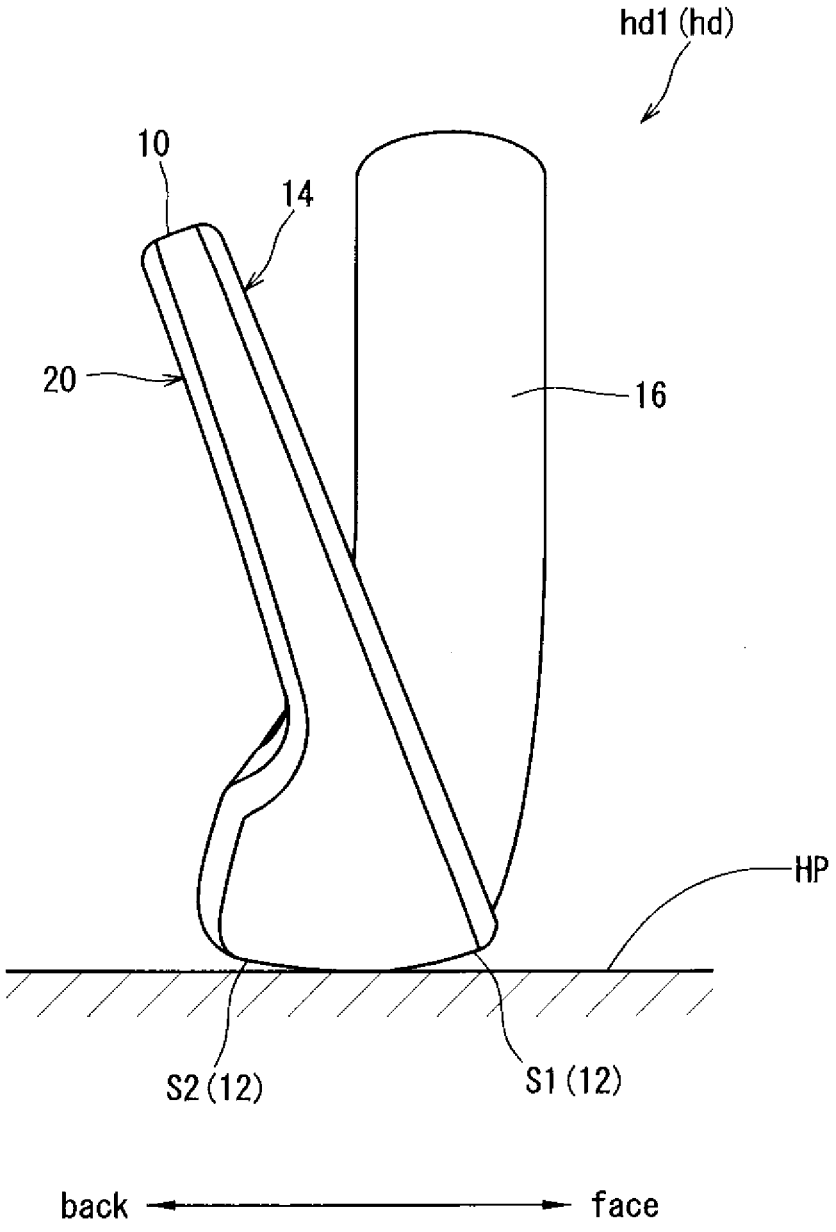
FIG. 3 is a side view of the head of FIG. 2.
Figure 4:
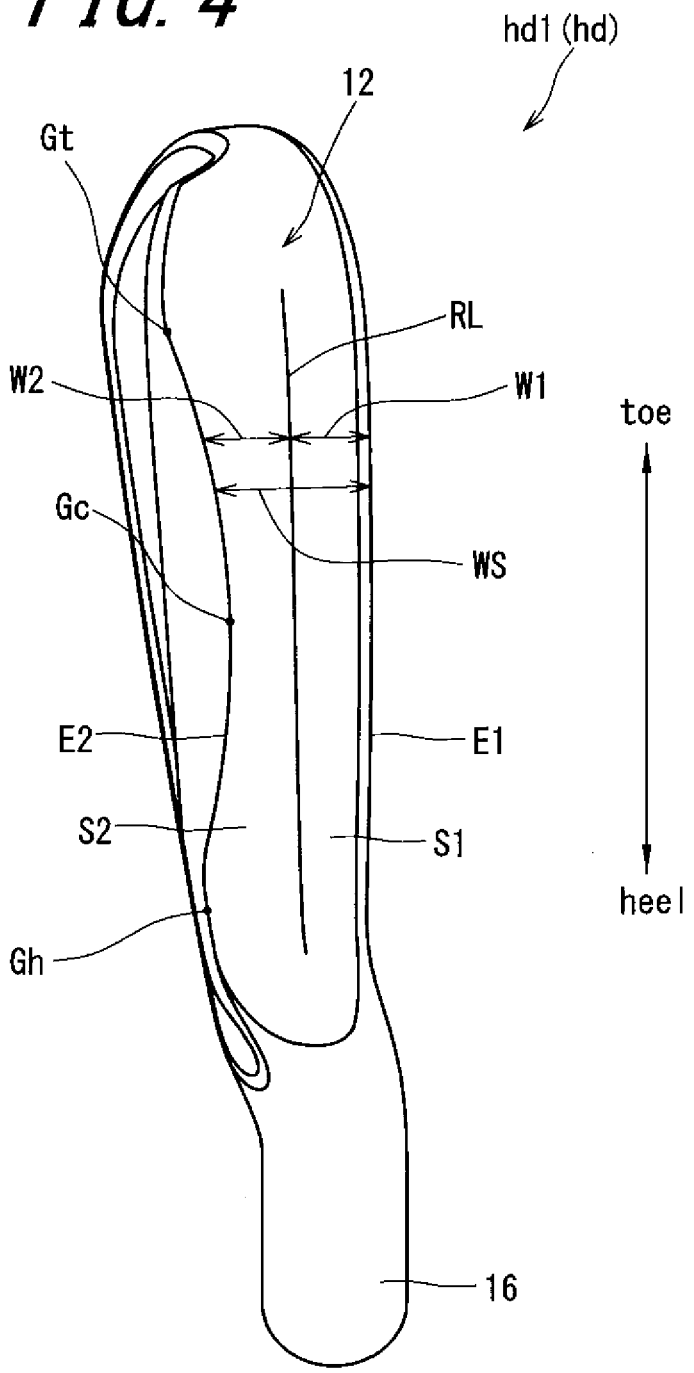
FIG. 4 is a bottom view of the head of FIG. 2.
Figure 5:
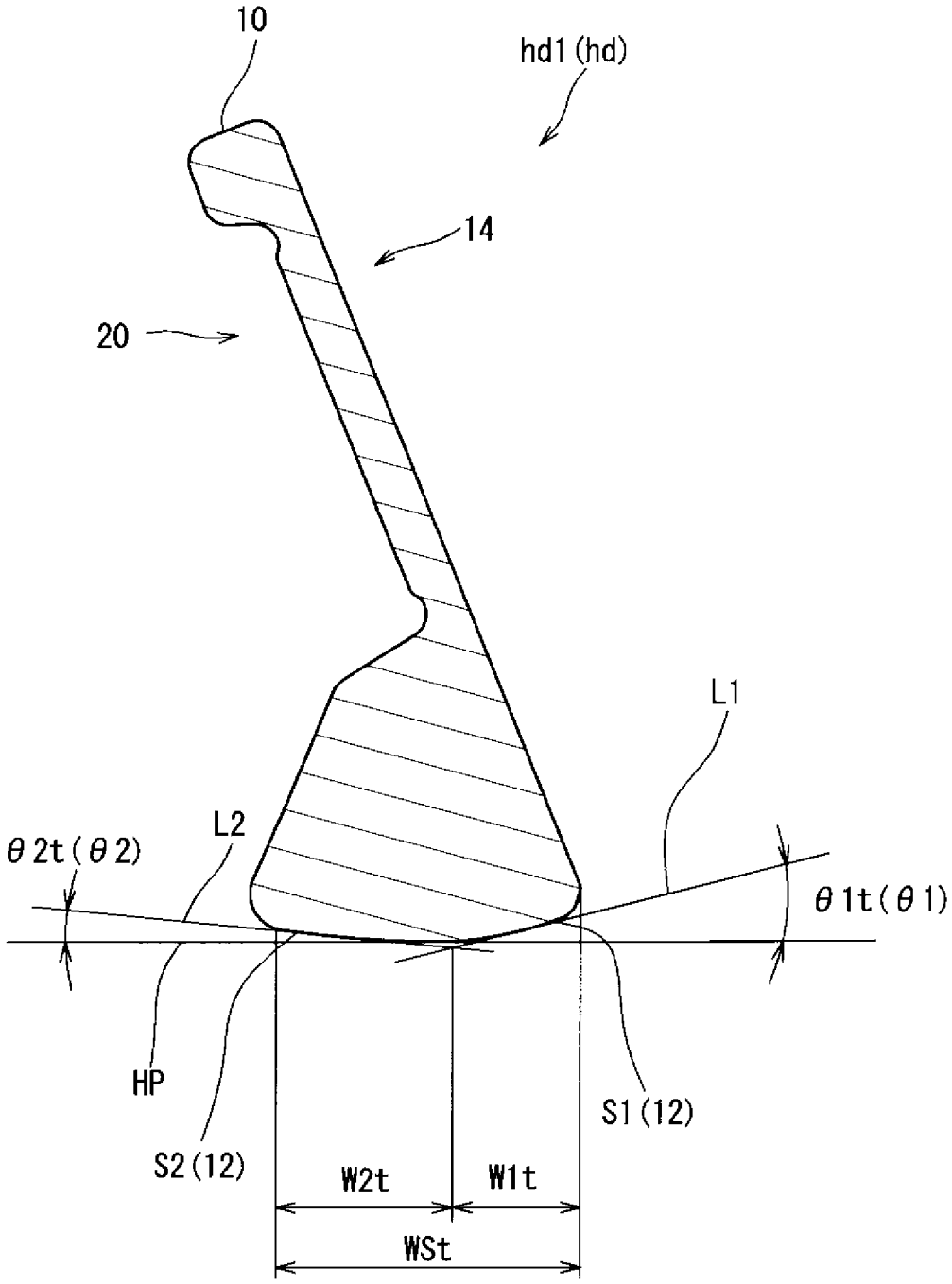
FIG. 5 is a sectional view taken along line F5-F5 of FIG. 2.
Figure 6:
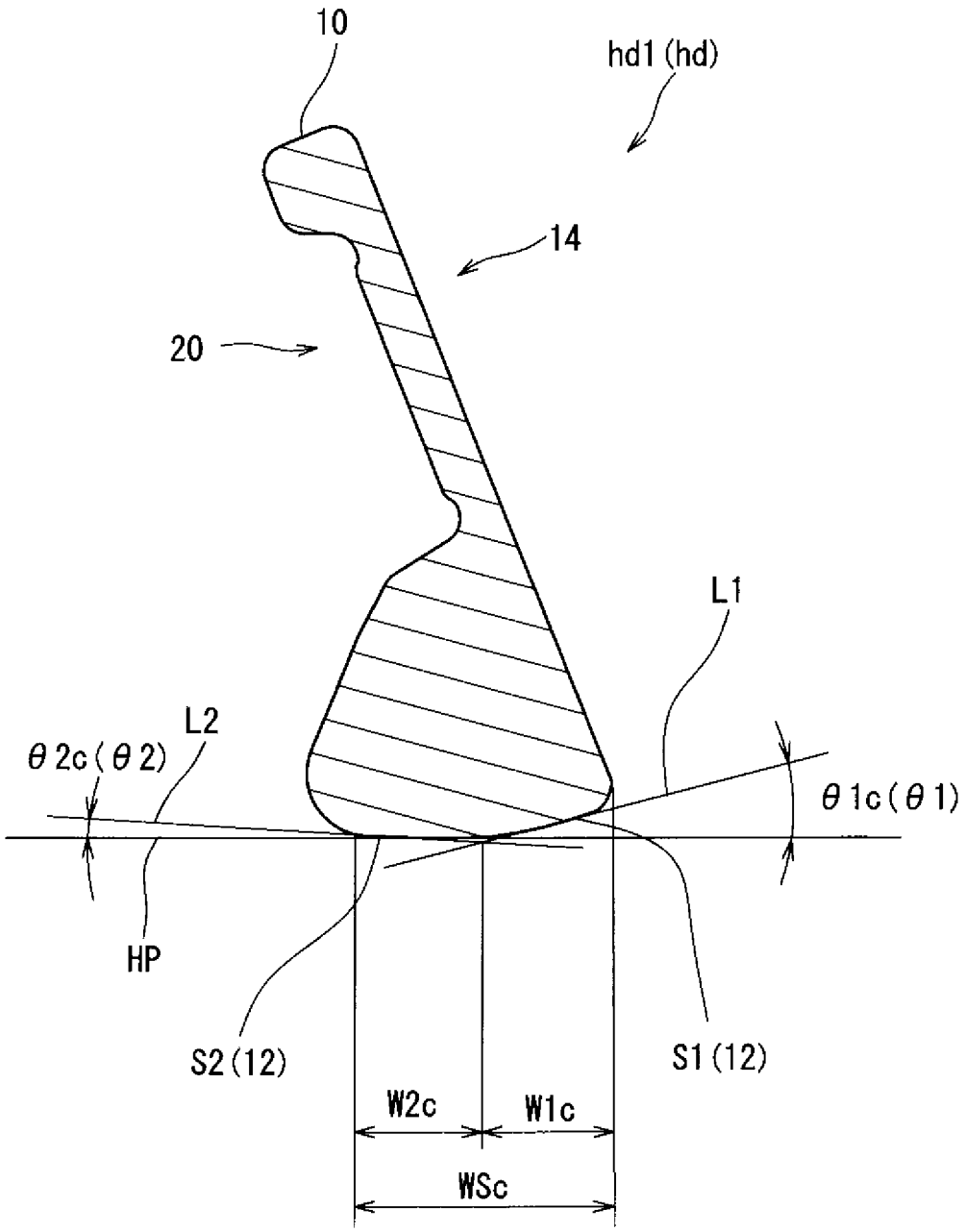
FIG. 6 is a sectional view taken along line F6-F6 of FIG. 2.
Figure 7:
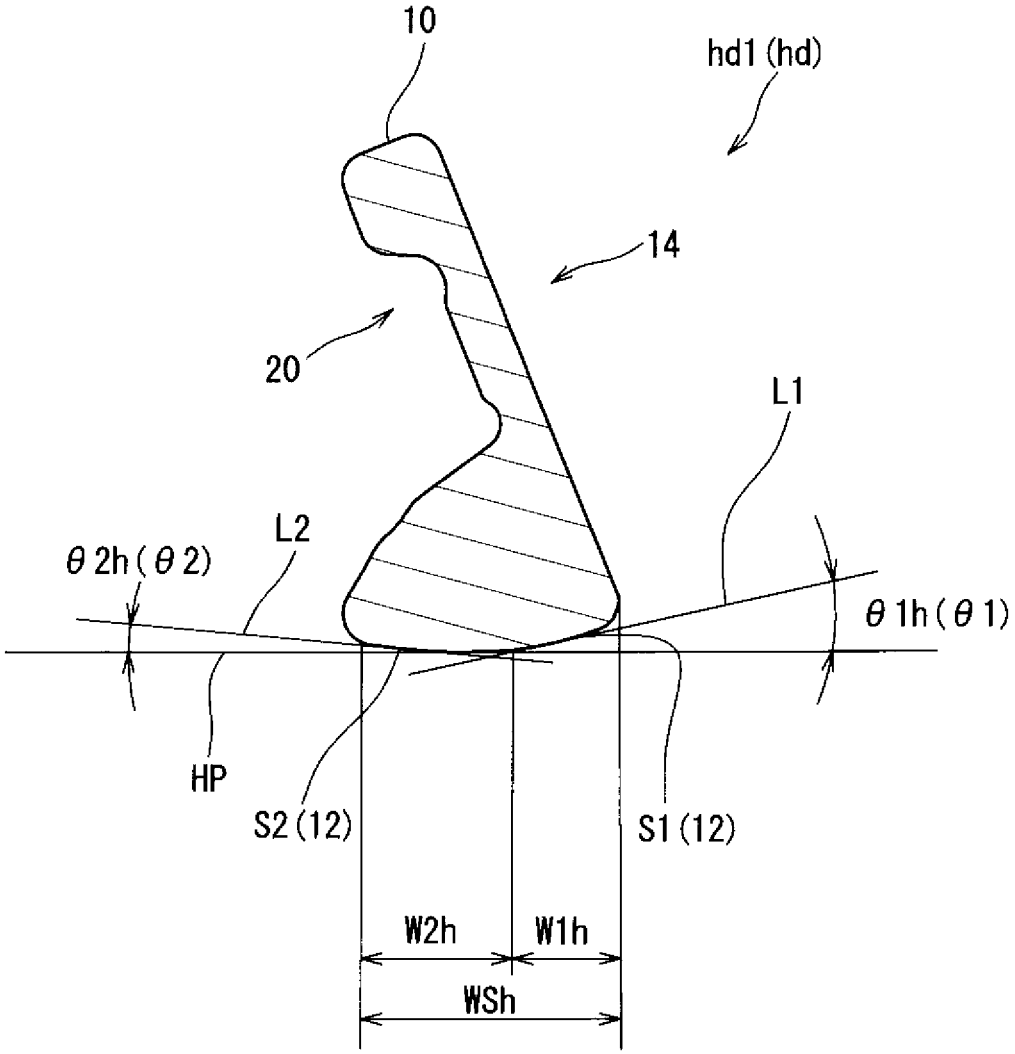
FIG. 7 is a sectional view taken along line F7-F7 of FIG. 2.

FIG. 2 is a front view of the head hd1 of the 4-iron (the above first club), as viewed from a direction perpendicular to a face surface. FIG. 3 is a side view of the head hd1. FIG. 4 is a bottom view of a head hd1, as viewed from a sole side. FIG. 5 is a sectional view taken along line F5-F5 of FIG. 2. FIG. 6 is a sectional view taken along line F6-F6 of FIG. 2. FIG. 7 is a sectional view taken along line F7-F7 of FIG. 2.

Figure 8:
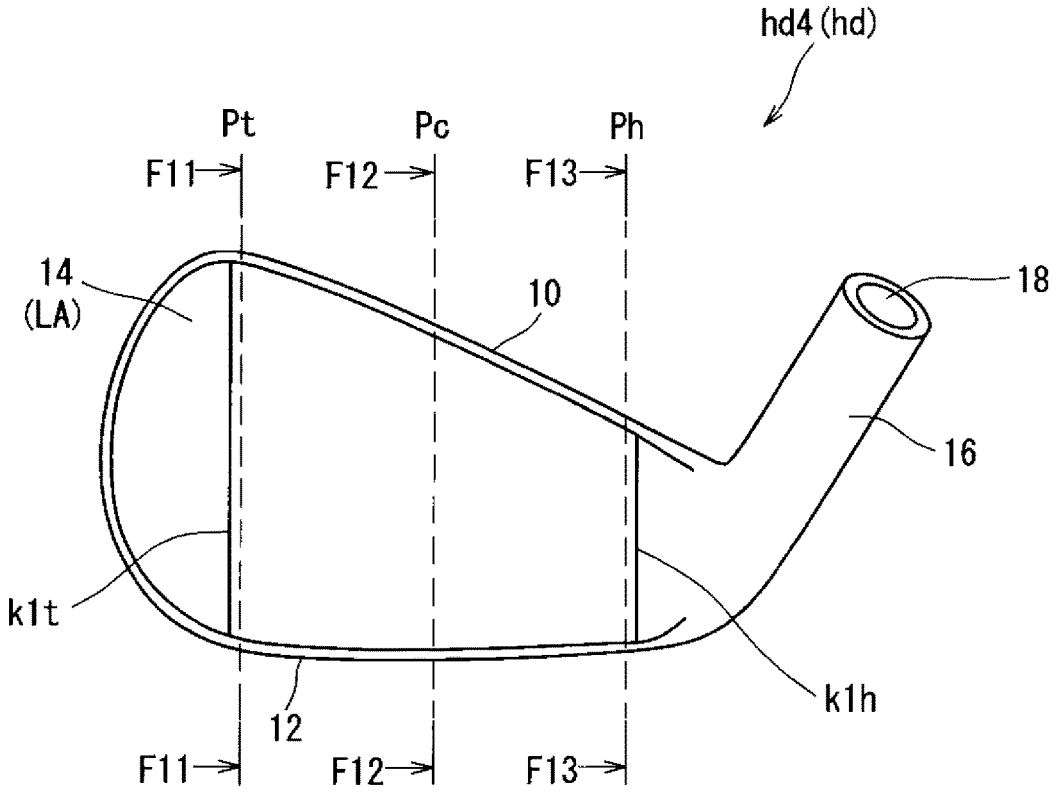
FIG. 8 is a front view of a head (7-iron) included in the set of FIG. 1, as viewed from the front of a face.
Figure 9:
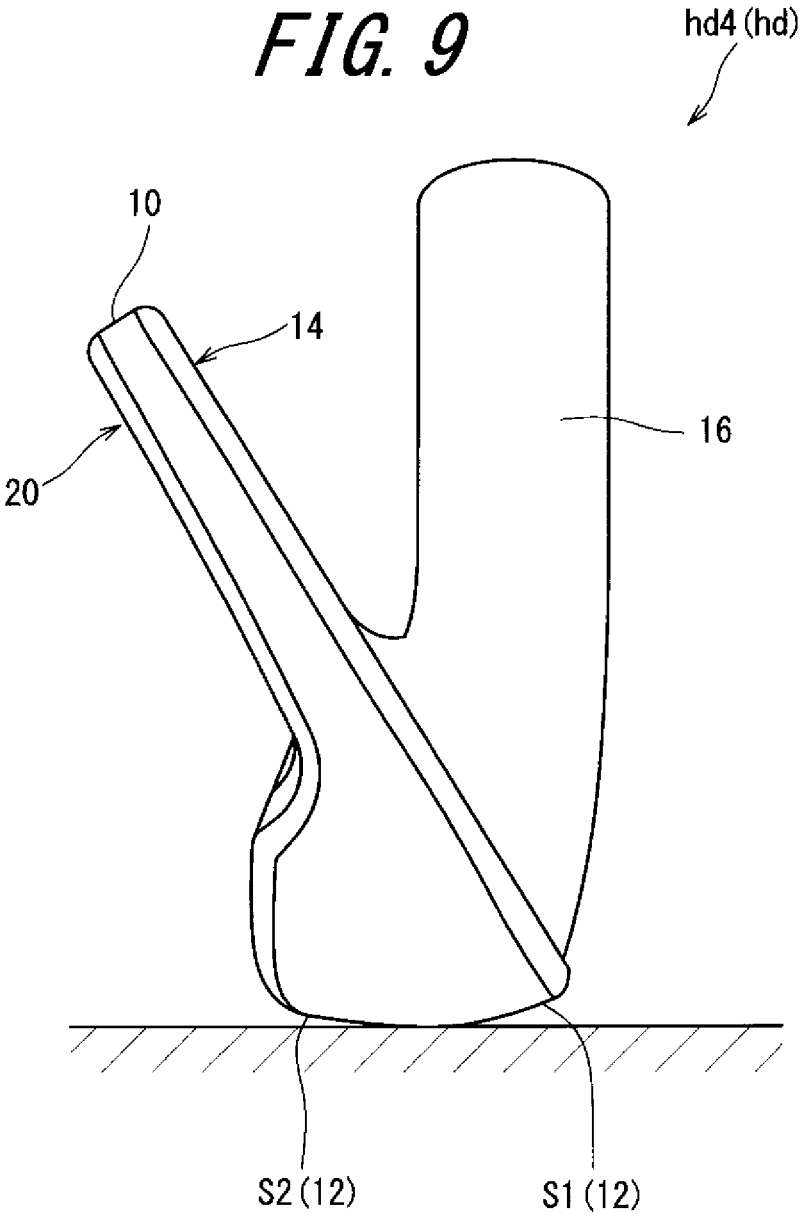
FIG. 9 is a side view of the head of FIG. 8.
Figure 10:
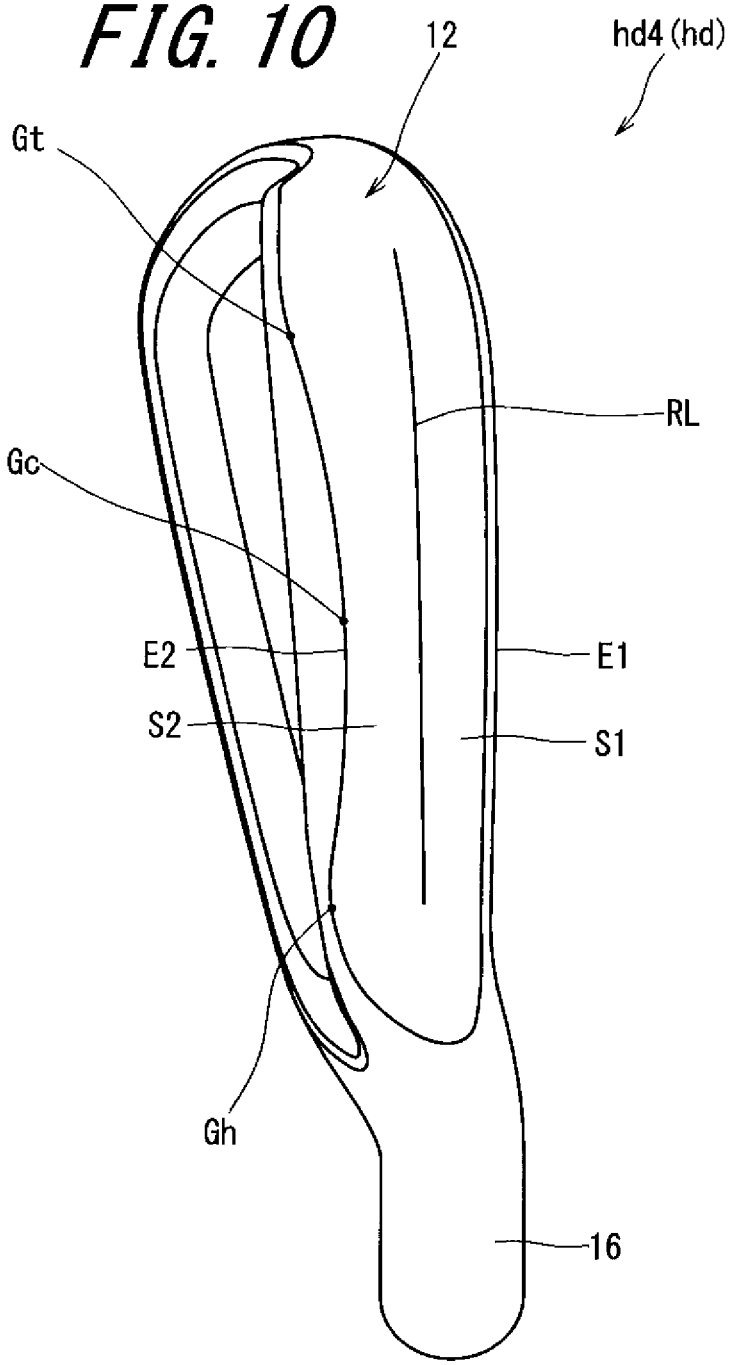
FIG. 10 is a bottom view of the head of FIG. 8.
Figure 11:
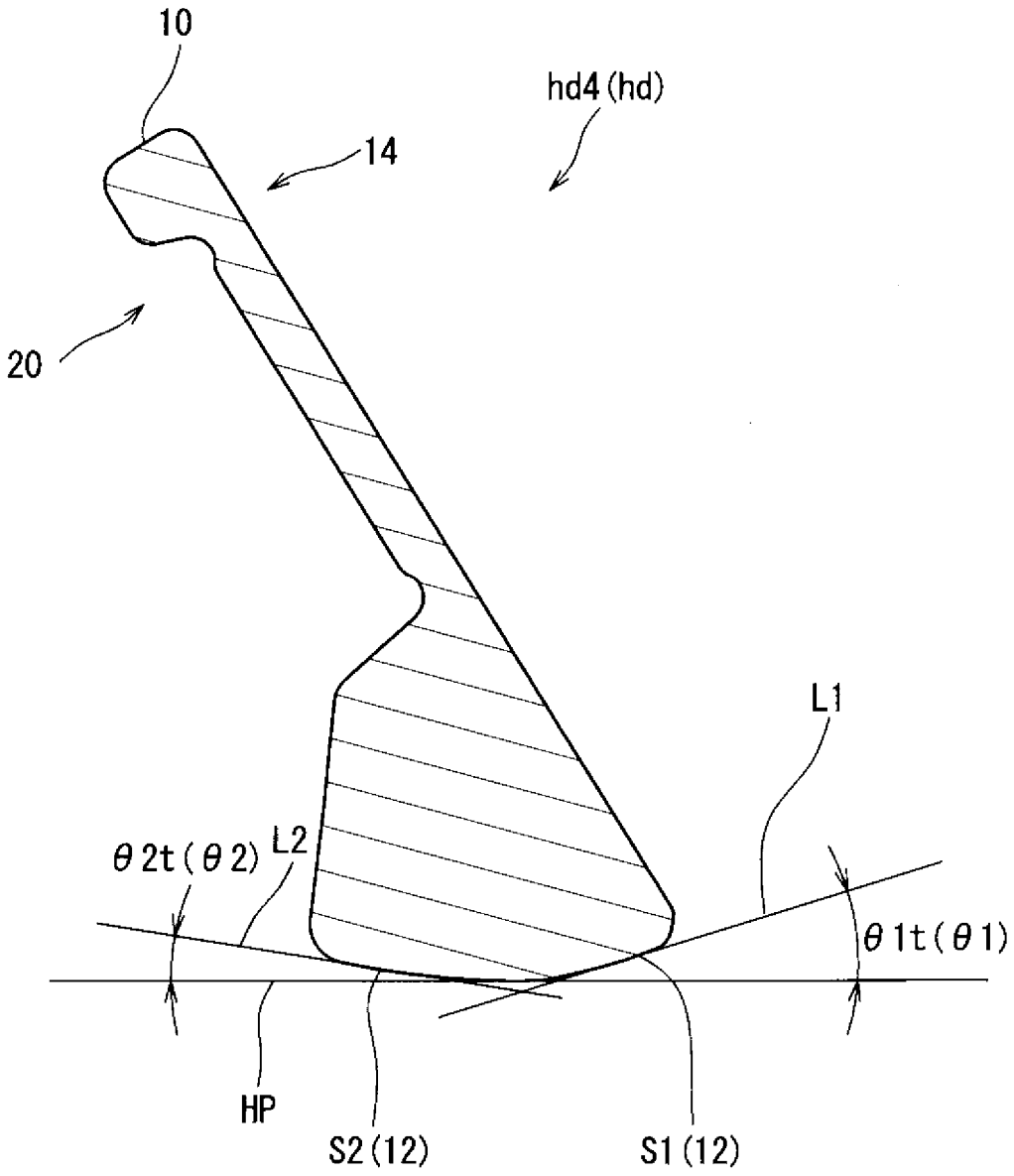
FIG. 11 is a sectional view taken along line F11-F11 of FIG. 8.
Figure 12:
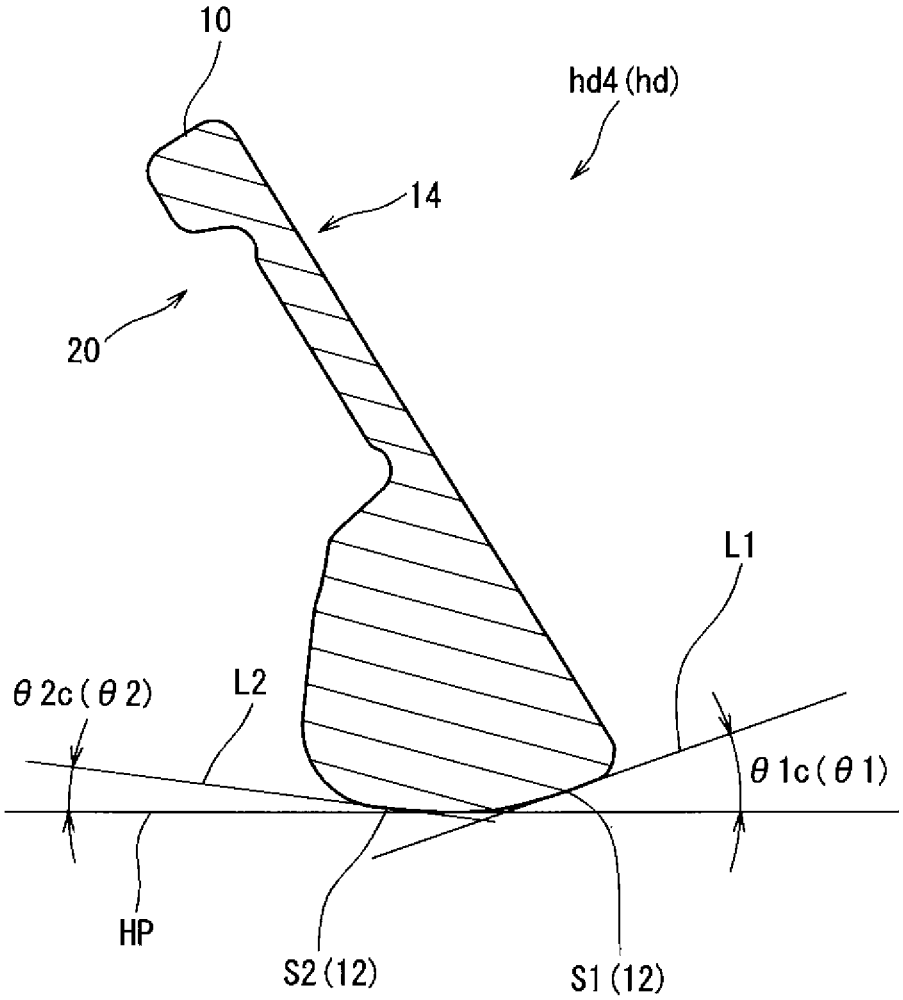
FIG. 12 is a sectional view taken along line F12-F12 of FIG. 8.
Figure 13:
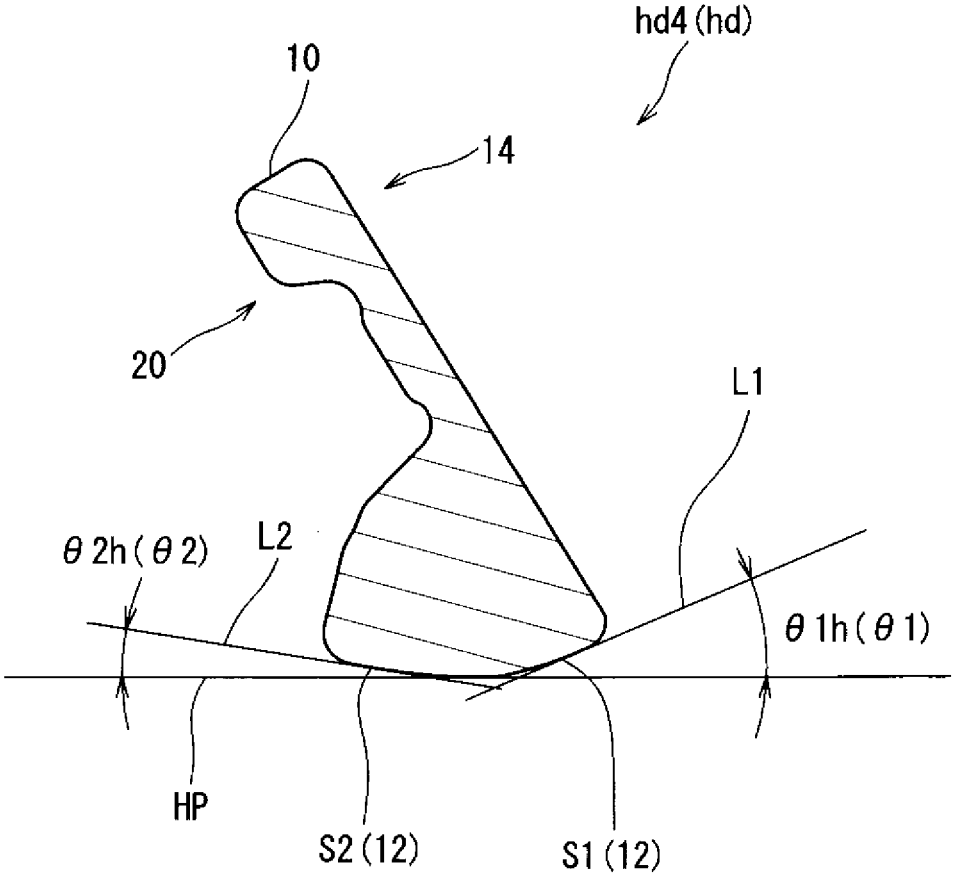
FIG. 13 is a sectional view taken along line F13-F13 of FIG. 8.

FIG. 8 is a front view of the head hd4 of the 7-iron (the above second club), as viewed from a direction perpendicular to a face surface. FIG. 9 is a side view of the head hd4. FIG. 10 is a bottom view of the head hd4, as viewed from a sole side. FIG. 11 is a sectional view taken along line F11-F11 of FIG. 8. FIG. 12 is a sectional view taken along line F12-F12 of FIG. 8. FIG. 13 is a sectional view taken along line F13-F13 of FIG. 8.

Figure 14:
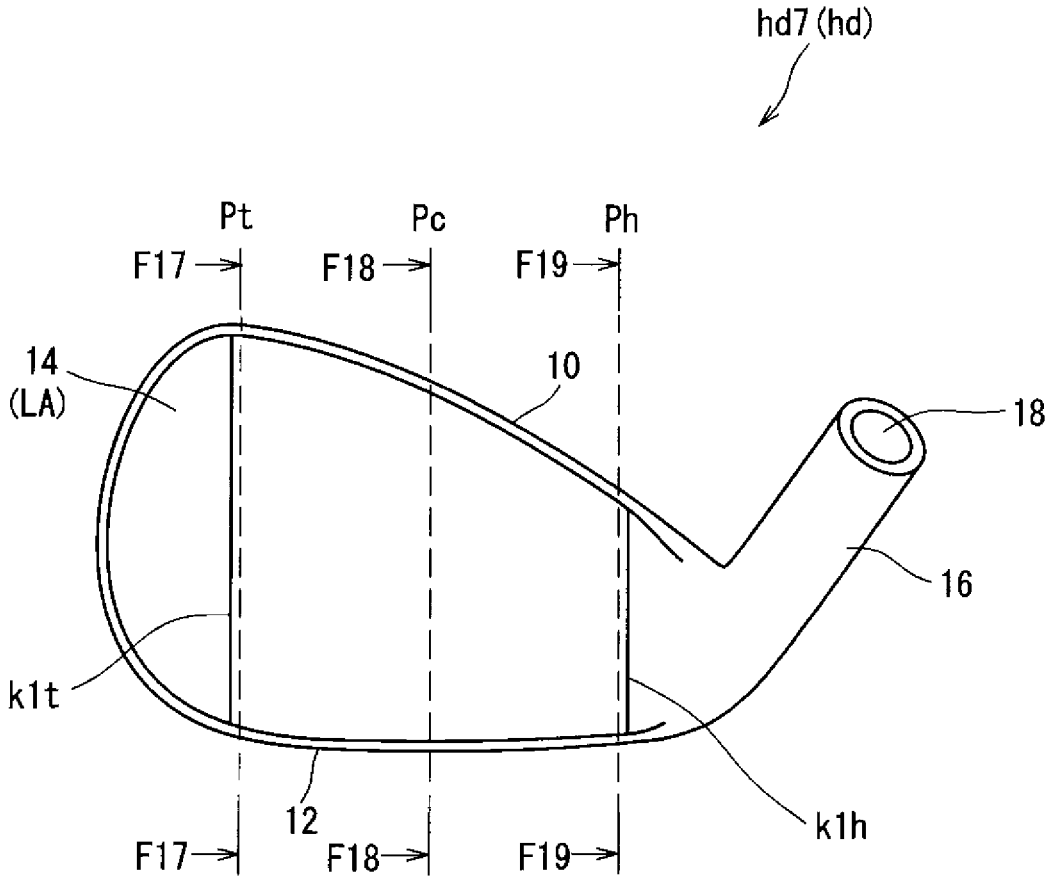
FIG. 14 is a front view of a head (pitching wedge) included in the set of FIG. 1, as viewed from the front of a face.
Figure 15:
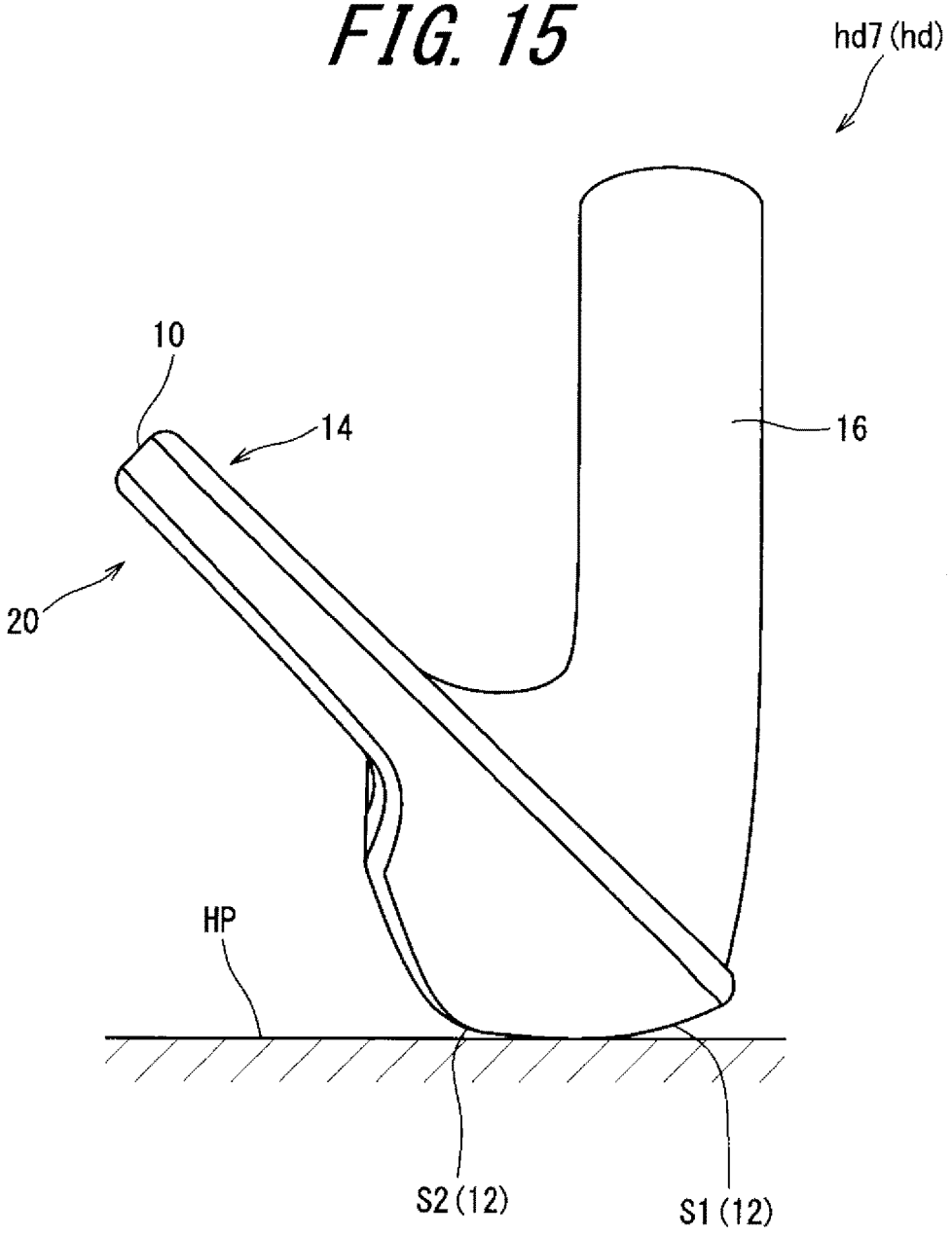
FIG. 15 is a side view of the head of FIG. 14.
Figure 16:
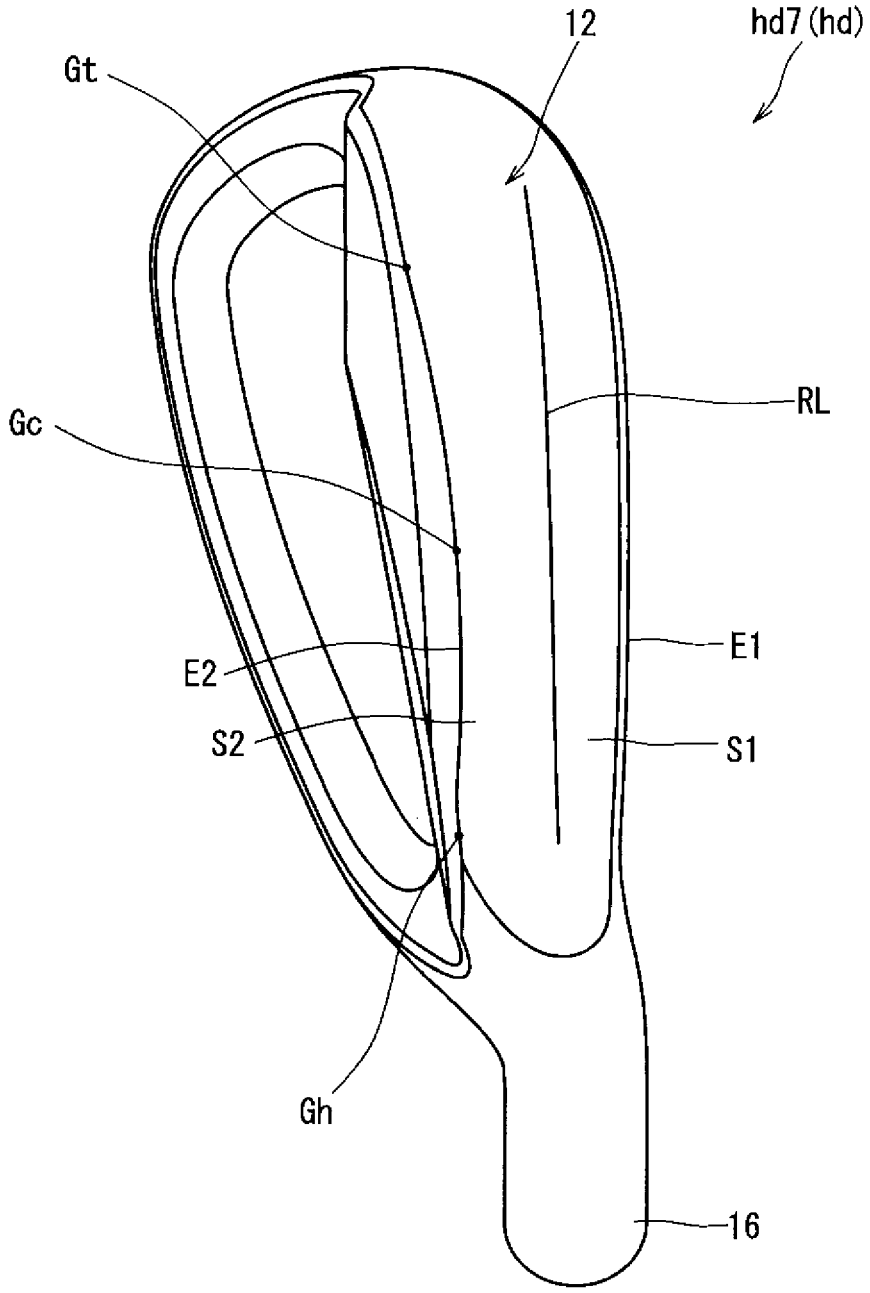
FIG. 16 is a bottom view of the head of FIG. 14.
Figure 17:
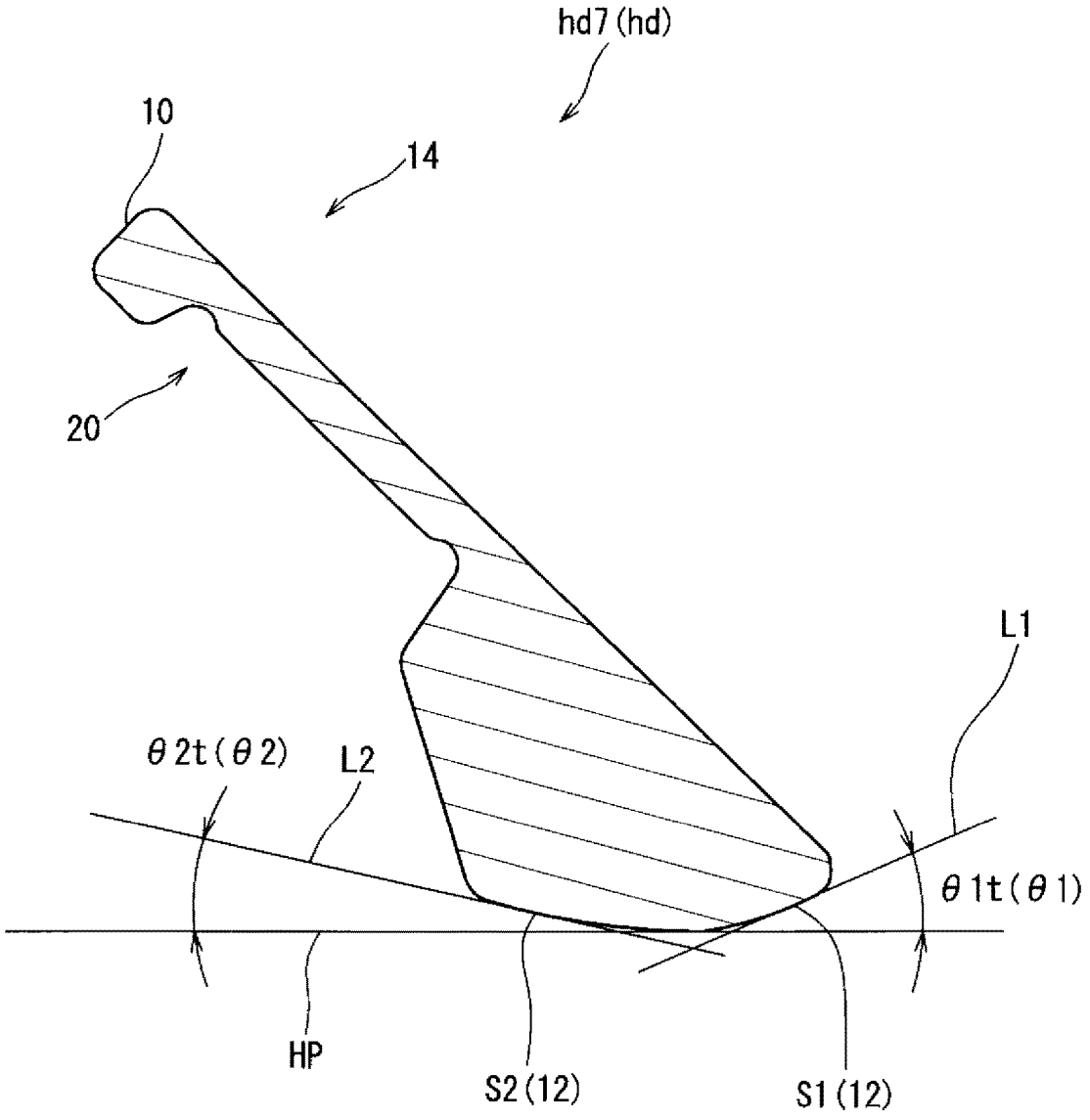
FIG. 17 is a sectional view taken along line F17-F17 of FIG. 14.
Figure 18:
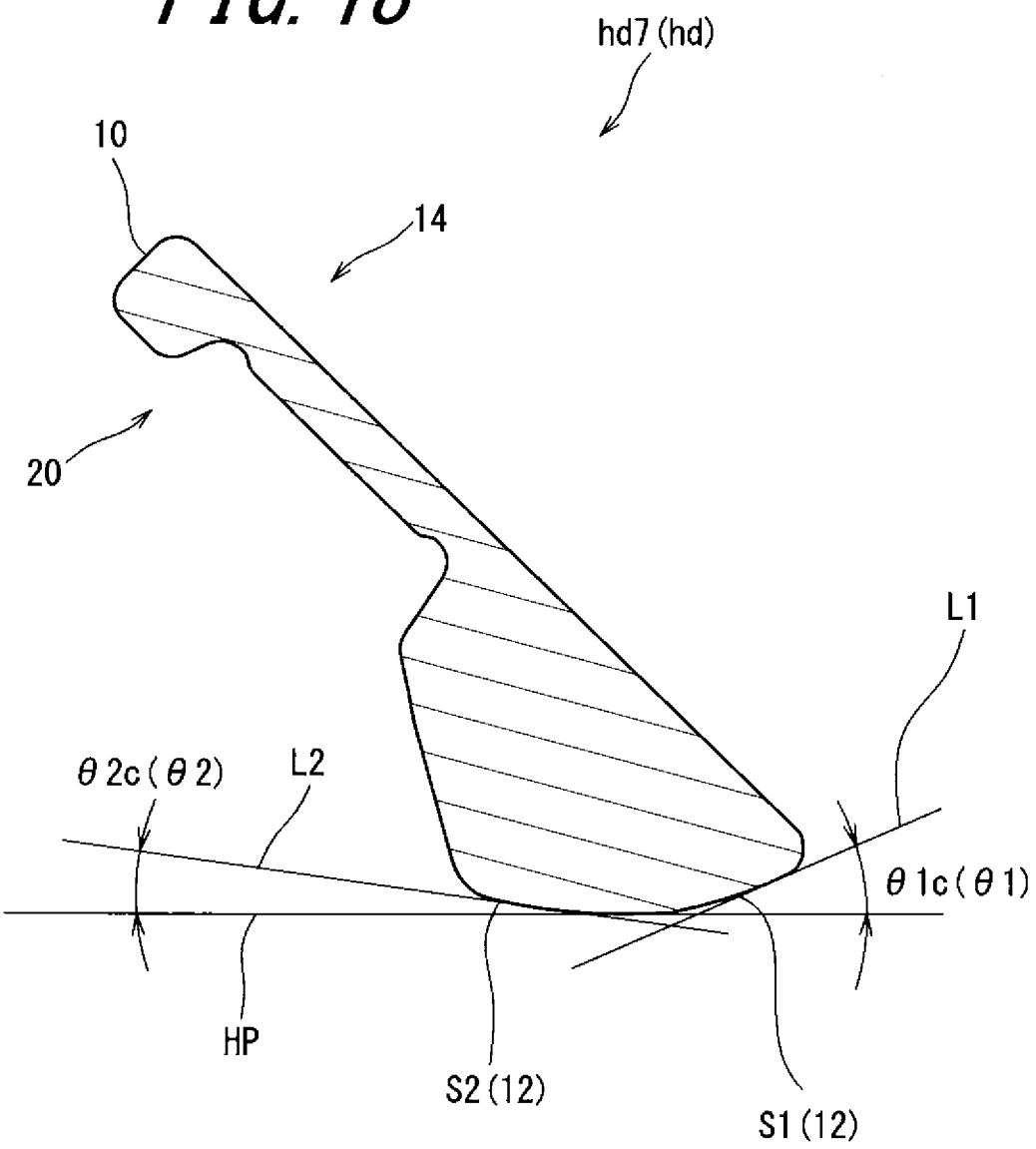
FIG. 18 is a sectional view taken along line F18-F18 of FIG. 14.
Figure 19:
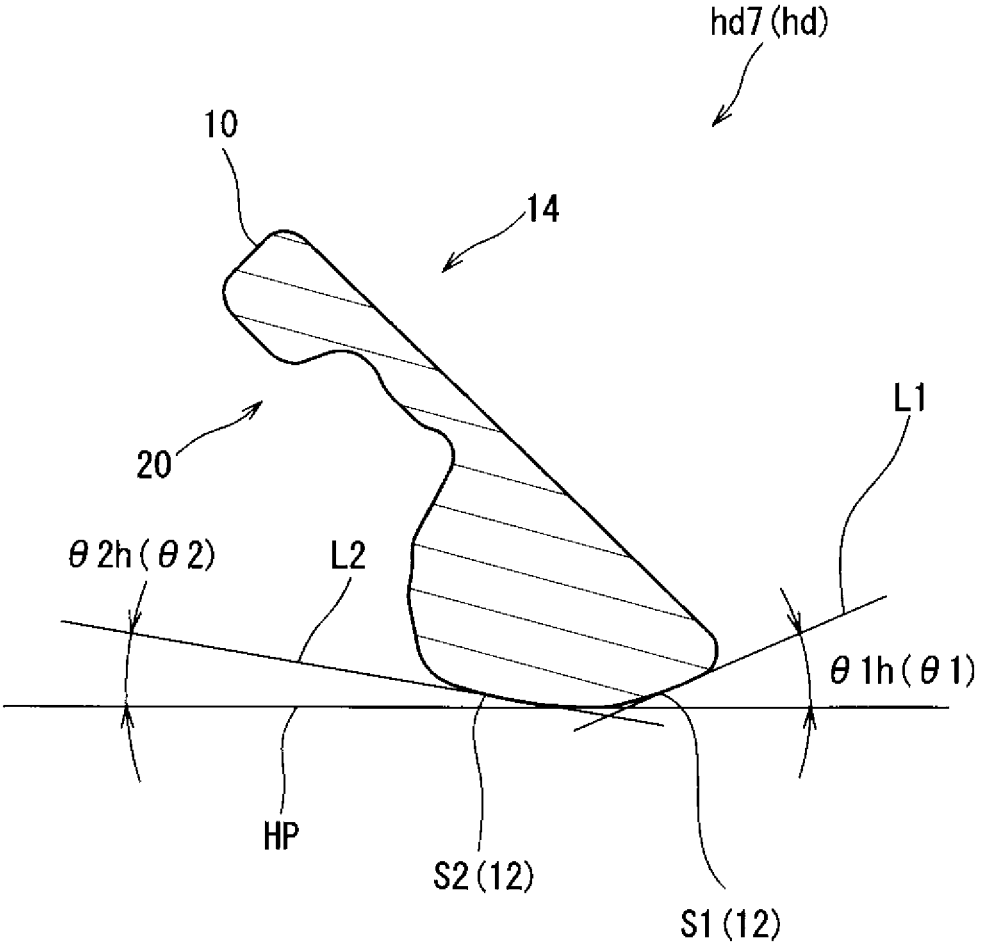
FIG. 19 is a sectional view taken along line F19-F19 of FIG. 14.

FIG. 14 is a front view of the head hd7 of the pitching wedge (the above third club), as viewed from a direction perpendicular to a face surface. FIG. 15 is a side view of the head hd7. FIG. 16 is a bottom view of the head hd7, as viewed from a sole side. FIG. 17 is a sectional view taken along line F17-F17 of FIG. 14. FIG. 18 is a sectional view taken along line F18-F18 of FIG. 14. FIG. 19 is a sectional view taken along line F19-F19 of FIG. 14.

Hereinafter, portions described as the head hd are matters common to all the iron numbers.

As shown in FIGS. 2 to 19, the head hd has a top surface 10, a sole surface 12, a face surface 14, and a hosel 16. The face surface 14 is a surface hitting a ball. The sole surface 12 forms a lower surface of the head hd. The sole surface 12 forms a surface projecting toward a lower side as a whole. The hosel 16 is positioned on a heel side of the head hd. The hosel 16 has a shaft hole 18 (see FIGS. 2, 8, and 14). The center axis line Z of the shaft hole 18 coincides with the axis line of the shaft.

The head hd further includes a back surface 20. The back surface 20 is a surface opposite to the face surface 14. A cavity (recess) is formed in the back surface 20. That is, the head hd is a so-called cavity back iron.

The material of the head hd is not limited. The head hd may be a metal, or may be a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include carbon fiber reinforced plastic (CFRP). The materials of a face portion and other portion may be different from each other.

The face surface 14 has a face line gv. The face line gv is also referred to as a score line or a face groove. The head hd1 has a plurality of face lines gv. Examples of a formation method of the face lines gv include forging, a press process, casting, and a cut process (carving). The plurality of face lines gv include the longest face line gv1. The description of the face line gv is omitted except for FIG. 2.

A part of the face surface 14 is subjected to a treatment for adjusting a surface roughness (see FIGS. 2, 8, and 14). The typical example of the treatment is a shot-blasting treatment. In the present embodiment, the shot-blasting treatment is adopted. As shown in FIG. 2, boundary lines k1 are visually recognized at boundaries between an area which is subjected to the shot-blasting treatment and an area which is not subjected to the shot-blasting treatment. The boundary lines k1 are a toe side boundary line k1*t* and a heel side boundary line k1*h*. An area between the boundary line k1*t* and the boundary line k1*h* is subjected to the shot-blasting treatment. All the face lines gv are formed in the area which is subjected to the shot-blasting treatment. An area on a toe side with respect to the toe side boundary line k1*t* is not subjected to the shot-blasting treatment. An area on a heel side with respect to the heel side boundary line k1*h* is not subjected to the shot-blasting treatment. The toe side boundary line k1*t* and the heel side boundary line k1*h* are visually recognized by the absence or presence of the shot-blasting treatment. The surface roughness is increased by the shot-blasting treatment. The increased surface roughness can increase a backspin rate.

The face surface 14 has a land area LA. The land area LA indicates a portion on which the face lines gv are not formed, of the face surface 14. If minute convexoconcave formed by the shot-blasting treatment or the like is disregarded, the land area LA is substantially a plane. Therefore, in the present application, the face surface 14 is treated as a plane. In the iron head hd, the face surface 14 is usually a plane.

As shown in FIGS. 4, 10, and 16, the sole surface 12 includes a ridgeline RL extending from a toe side toward a heel side, a leading surface S1 positioned on a face side of the ridgeline RL, and a trailing surface S2 positioned on a back side of the ridgeline RL. The ridgeline RL is a boundary line between the leading surface S1 and the trailing surface S2. The leading surface S1 extends between the ridgeline RL and a leading edge E1. The trailing surface S2 extends between the ridgeline RL and a trailing edge E2.

The leading surface S1 is a convex curved surface which smoothly continues as a whole. The trailing surface S2 is a convex curved surface which smoothly continues as a whole.

The ridgeline RL is formed by a vertex of the sole surface 12. The ridgeline RL is a line which can be visually recognized. In the section taken along the face-back direction, the ridgeline RL constitutes the vertex of the sole surface 12. The vertex may have roundness, and the roundness preferably has a curvature radius of equal to or less than 7 mm.

In all positions in the toe-heel direction, the sections taken along the face-back direction may be defined. In all the sections, the ridgeline RL constitutes a lowest point.

The projection height of the ridgeline RL is decreased from the toe reference position Pt toward the heel reference position Ph. The projection height is a distance (shortest distance) between the ridgeline RL and a straight line connecting the leading edge E1 to the trailing edge E2. The ridgeline RL is three-dimensionally curved so as to project toward a lower side.

The leading surface S1 extends from the ridgeline RL toward the face side. A face side end of the leading surface S1 is the leading edge E1 (see FIGS. 4, 10, and 16). The leading surface S1 is inclined upward toward the face side. Although the leading surface S1 is a curved surface projecting toward an outer side, it is substantially a plane. From the viewpoint to be described later, the leading surface S1 is preferably a plane or substantially a plane. Therefore, in the section taken along the face-back direction, the leading surface S1 preferably has a curvature radius of equal to or greater than 20 mm. The leading surface S1 may be a plane. In the section taken along the face-back direction, the leading surface S1 may be a straight line.

The trailing surface S2 extends from the ridgeline RL toward the back side. A back side end of the trailing surface S2 is the trailing edge E2 (see FIGS. 4, 10, and 16). The trailing surface S2 is inclined upward toward the back side. Although the trailing surface S2 is a curved surface projecting toward an outer side, it is close to a plane. From the viewpoint to be described later, preferably, the trailing surface S2 is a plane or close to a plane. Therefore, in the section taken along the face-back direction, the trailing surface S2 preferably has a curvature radius of equal to or greater than 30 mm. The trailing surface S2 may be a plane. In the section taken along the face-back direction, the trailing surface S2 may be a straight line.

Thus, the sectional shape of the sole surface 12 in the section taken along the face-back direction is a chevron with the ridgeline RL as the vertex. Only the ridgeline RL is brought into contact with the horizontal plane HP in the reference state.

As is understood from FIG. 2 or the like, the sectional shape of the sole surface 12 in the section taken along the toe-heel direction is curved so as to project toward a lower side. A portion (contact portion) which is brought into contact with the horizontal plane HP in the reference state is one place on the ridgeline RL. In the reference state, a gap between the ridgeline RL and the horizontal plane HP is increased from the contact portion toward the toe side. In the reference state, the gap between the ridgeline RL and the horizontal plane HP is increased from the contact portion toward the heel side.

[Effect of Ridgeline Sole]

The structure having the leading surface S1 and the trailing surface S2 with the ridgeline RL as a boundary exhibits the following effect.

Before the ridgeline RL passes through the ground near an impact, the leading surface S1 is opposed to the ground. However, the leading surface S1 does not largely project toward the ground, which provides a reduction in resistance received from the ground. As a result, a reduction in a head speed involving the ground resistance can be suppressed.

When a swing further proceeds, the ridgeline RL is grounded. Since the sole surface 12 projects in the ridgeline RL, the sole surface 12 intensively receives the resistance from the ground in the ridgeline RL. Therefore, the head hd is rotated at once by grounding the ridgeline RL. The head hd is rotated so that it falls over forward around the ridgeline RL. The rotation of the head hd is rotation in a direction in which the loft angle (loft angle with respect to vertical line) of the head hd is decreased. A gear effect is provided by the rotation of the head hd. That is, since the ridgeline RL intensively receives the resistance from the ground, the gear effect is provided at once. The gear effect provides an increase in the backspin rate. When the sole surface is a mere convex surface, the convex surface already receives the resistance on the face side with respect to the ridgeline RL, which provides the dispersion of the resistance received by the sole surface 12. For this reason, the above rapid rotation of the head hd is not provided, which causes a decrease in the gear effect. Therefore, the increase effect of the backspin rate is also decreased.

After the ridgeline RL passes through the ground, the trailing surface S2 is opposed to the ground. However, the trailing surface S2 does not largely project toward the ground as with the leading surface S1, which provides a reduction in the resistance (ground resistance) received from the ground. As a result, a reduction in a head speed involving the ground resistance can be suppressed, which can provide an improvement in coming loose performance.

The inclination angle of the leading surface S1 is shown by a double-headed arrow θ1 in FIGS. 5, 6, and 7 or the like. In the reference state, the section taken along the face-back direction is considered. In the section, a straight line L1 taken along the leading surface S1 is defined. When the sectional line of the leading surface S1 is a curved line, the tangent of a middle point of the sectional line is defined as the straight line L1. An angle between the straight line L1 and the horizontal plane HP is the inclination angle θ1 of the leading surface S1. The middle point means a point bisecting the face-back direction width of the sectional line of the leading surface S1.

The inclination angle θ1 at the toe reference position Pt is an angle θ1*t* (see FIGS. 5, 11, and 17). The inclination angle θ1 at the middle position Pc is an angle θ1*c* (see FIGS. 6, 12, and 18). The inclination angle θ1 at the heel reference position Ph is an angle θ1*h* (see FIGS. 7, 13, and 19).

In the set 2, the inclination angle θ1 is increased as the loft angle is increased. In more detail, the inclination angle θ1*t* is increased as the loft angle is increased. The inclination angle θ1*c* is increased as the loft angle is increased. The inclination angle θ1*h* is increased as the loft angle is increased.

The comparatively short club 4 (for example, the above third club) is most commonly used for a shot targeting a comparatively narrow area such as a green.

For this reason, an increase in the backspin rate is required for the short club 4. In the set 2, the inclination angle θ1 in the short club 4 is increased, which can provide a further increase in the concentration of the ground resistance to the ridgeline RL. Therefore, the above head rotation is further promoted, which provides a further improvement in the gear effect. As a result, the backspin rate is further increased. Meanwhile, the inclination angle θ1 is decreased in the comparatively long club 4 (for example, the above first club), which suppresses excessive head rotation. As a result, the initial conditions (for example, launch angle, spin rate) of the shot are stabilized. In addition, ballooning (blow-up) caused by excessive backspin is prevented.

In each iron number of the set 2, a difference among the inclination angle θ1*t*, the inclination angle θ1*c*, and the inclination angle θ1*h* is comparatively small. The constitution stably provides the concentration of the ground resistance to the ridgeline RL even if the ground position fluctuates in the toe-heel direction. For this reason, the above fluctuation of the gear effect is decreased, which stabilizes the backspin rate. From this viewpoint, a difference between the inclination angle θ1*t* and the inclination angle θ1*c* in each head hd is preferably equal to or less than 3 degrees, and more preferably equal to or less than 2 degrees. Similarly, in each head hd, a difference between the inclination angle θ1*h* and the inclination angle θ1*c* is preferably equal to or less than 3 degrees, and more preferably equal to or less than 2 degrees.

The inclination angle of the trailing surface S2 is shown by a double-headed arrow θ2 in FIGS. 5, 6, and 7 or the like. In the reference state, the section taken along the face-back direction is considered. In the section, a straight line L2 taken along the trailing surface S2 is defined. When the sectional line of the trailing surface S2 is a curved line, the tangent of a middle point of the sectional line is defined as the straight line L2. An angle between the straight line L2 and the horizontal plane HP is the inclination angle θ2 of the trailing surface S2. The middle point means a point bisecting the face-back direction width of the sectional line of the trailing surface S2.

The inclination angle θ2 at the toe reference position Pt is an angle θ2*t* (see FIGS. 5, 11, and 17). The inclination angle θ2 at the middle position Pc is an angle θ2*c* (see FIGS. 6, 12, and 18). The inclination angle θ2 at the heel reference position Ph is an angle θ2*h* (see FIGS. 7, 13, and 19). In the head hd, the inclination angle θ2*t* is greater than the inclination angle θ2*c* (θ2*t*>θ2*c*). In the head hd, the inclination angle θ2*h* is greater than the inclination angle θ2*c* (θ2*h*>θ2*c*).

In the head hd1 (the first club), θ2*t*>θ2*c* is satisfied. In the head hd4 (the second club), θ2*t*>θ2*c* is satisfied. In the head hd7 (the third club), θ2*t*>θ2*c* is satisfied. In all the iron numbers of the set 2, θ2*t*>θ2*c* is satisfied.

In the head hd1 (the first club), θ2*h*>θ2*c* is satisfied. In the head hd4 (the second club), θ2*h*>θ2*c* is satisfied. In the head hd7 (the third club), θ2*h*>θ2*c* is satisfied. In all the iron numbers of the set 2, θ2*h*>θ2*c* is satisfied.

The inclination angle θ2 is gradually or intermittently changed from the middle position Pc toward the toe reference position Pt. The inclination angle θ2 is gradually or intermittently changed from the middle position Pc toward the heel reference position Ph. The term "intermittently" means that a portion in which the inclination angle θ2 is constant may be included.

The inclination angle θ2 is gradually or intermittently increased from the middle position Pc toward the toe reference position Pt. The inclination angle θ2 is gradually or intermittently increased from the middle position Pc toward the heel reference position Ph.

[Sole Width WS, Width W1 of Leading Surface S1, Width W2 of Trailing Surface S2]

The width of the leading surface S1 is shown by a double-headed arrow W1 in FIG. 4. The width W1 is measured along the face-back direction. The width of the trailing surface S2 is shown by a double-headed arrow W2 in FIG. 4. The width W2 is measured along the face-back direction. The width of the sole surface 12 is shown by a double-headed arrow WS in FIG. 4. The sole width WS is a distance between the leading edge E1 and the trailing edge E2. The width WS is measured along the face-back direction. The sole width WS is the sum of the width W1 and the width W2.

[Widths WSt, WSc, WSh]

As shown in FIG. 5, the sole width WS at the toe reference position Pt is WSt. As shown in FIG. 6, the sole width WS at the middle position Pc is WSc. As shown in FIG. 7, the sole width WS at the heel reference position Ph is WSh.

[Widths W1*t*, W1*c*, W1*h*, W2*t*, W2*c*, W2*h*]

As shown in FIG. 5, the width W1 at the toe reference position Pt is W1*t*. As shown in FIG. 6, the width W1 at the middle position Pc is W1*c*. As shown in FIG. 7, the width W1 at the heel reference position Ph is W1*h*. As shown in FIG. 5, the width W2 at the toe reference position Pt is W2*t*. As shown in FIG. 6, the width W2 at the middle position Pc is W2*c*. As shown in FIG. 7, the width W2 at the heel reference position Ph is W2*h*. The sole width WSt is the sum of the width W1*t* and the width W2*t*. The sole width WSc is the sum of the width W1*c* and the width W2*c*. The sole width WSh is the sum of the width W1*h* and the width W2*h*.

In the head hd, at the toe reference position Pt, the width W2*t* is greater than the width Wit. In the head hd, at the heel reference position Ph, the width W2*h* is greater than the width W1*h*. Therefore, the effect of the trailing surface S2 is improved on the toe and heel sides.

From the viewpoint of also securing the function provided by the leading surface S1 while improving the function of the trailing surface S2, W2*t*/WSt is preferably greater than 0.5 but 0.75 or less. From the viewpoint of also securing the function provided by the leading surface S1 while improving the function of the trailing surface S2, W2*h*/WSh is preferably greater than 0.5 but 0.75 or less.

[Curvature Radius of Trailing Edge E2]

In FIGS. 4, 10, and 16, a point Gt is a point on the trailing edge E2, and is a point at the toe reference position Pt. A point Gc is a point on the trailing edge E2, and is a point at the middle position Pc. A point Gh is a point on the trailing edge E2, and is a point at the heel reference position Ph. In the present application, the curvature radius of the trailing edge E2 is defined. In planar view as shown in FIG. 4, the curvature radius of a circle which passes through the three points (point Gt, point Gc, and point Gh) is defined as the curvature radius of the trailing edge E2. In the planar view, the circle which passes through the three points (point Gt, point Gc, and point Gh) is defined as a curvature definite circle.

If the sole width WS is rapidly changed, the resistance received by the head hd from the grass is apt to be unstable. Therefore, in the head hd, preferably, the sole width WS is gradually changed. From this viewpoint, preferably, the trailing edge E2 of the head hd is substantially taken along the curvature definite circle. In other words, displacement between the trailing edge E2 and the curvature definite circle is preferably decreased. In light of this point, in the trailing edge E2 between the point Gt and the point Gh, a distance (displacement distance) between the curvature definite circle and the trailing edge E2 is preferably equal to or less than 4 mm, and more preferably equal to or less than 2 mm. The displacement distance is measured along the face-back direction.

[Trailing Edge E2 Curved so as to Project Toward Face Side]

In the head hd1 (the first club) of FIG. 4, the trailing edge E2 is curved so as to project toward the face side. In the head hd4 (the second club) of FIG. 10, the trailing edge E2 is curved so as to project toward the face side. In the head hd7 (the third club) of FIG. 16, the trailing edge E2 is curved so as to project toward the face side. In the head hd, the trailing edge E2 is curved so as to project toward the face side. In the set 2, in all the clubs 4 (iron numbers), the trailing edge E2 is curved so as to project toward the face side.

[Effect of Trailing Edge E2 Curved so as to Project]

Since the sole widths WS on the toe and heel sides are increased by the trailing edge E2 curved so as to project toward the face side, much weight is distributed to these areas. Therefore, the lateral moment of inertia of the head is increased. As a result, the lateral deviation (deviation involving rotation around an axis taken along the up-down direction) of the head hd at an impact is decreased, which stabilizes the direction of a hit ball. If an axis taken along the up-down direction and passing through the center of gravity of the head is defined as an up-down direction axis, the lateral moment of inertia is a moment of inertia about the up-down direction axis.

Since the particularly long club 4 (for example, the above first club) provides a long flight distance, the deviation of the head at an impact largely influences the directivity of the hit ball. Therefore, it is effective to increase the lateral moment of inertia in the long club 4.

Since the rotation radius (radius of head path) of the swing is increased in the long club 4, the moving distance of the head hd while being brought into contact with the grass is increased. Therefore, in the long club 4, the head path while being brought into contact with the grass largely influences the directivity and the flight distance of the hit ball. In the set 2, the sole width WS of the long club 4 is increased on the toe and heel sides. For this reason, a contact area with the grass is increased on the toe and heel sides. The increased contact area functions as a guide when the head hd is slid on the surface of the grass, which stabilizes the head path. As a result, in the long club 4, the directivity and the flight distance are stabilized.

In the set 2, the term "flow" is adopted for a plurality of specs. The "flow" means a gradual change in the spec involving a change in the loft angle (or the club length).

[Flow of Sole Width WSc]

In the set 2, the sole width WSc at the middle position Pc is increased as the loft angle is increased. In other words, the sole width WSc is increased as the club length is decreased. Therefore, the sole width WSc of the head hd7 (the third club) is greater than the sole width WSc of the head hd4 (the second club). The sole width WSc of the head hd4 (the second club) is greater than the sole width WSc of the head hd1 (the first club).

[Effect of Flow of Sole Width WSc (Comparatively Long Club)]

Since the rotation radius (radius of head path) of the swing is increased in the long club 4, the moving distance of the head hd while being brought into contact with the grass is increased. Therefore, in the long club 4, the resistance caused by the contact with the grass largely influences coming loose performance. Since the middle portion of the sole surface 12 most deeply gets into under the grass, the resistance from the grass is increased. By decreasing the sole width WSc of the middle position Pc in the long club 4, the resistance can be effectively reduced.

[Effect of Flow of Sole Width WSc (Comparatively Short Club)]

Since the rotation radius (radius of head path) of the swing is decreased in the short club 4, the head hd comes in the grass surface at an acute angle (a large attack angle) with respect to the grass surface. Therefore, the head hd very deeply gets into under the grass, which is apt to cause the catching of the grass. By increasing the sole width WSc at the middle position Pc in the short club 4, a contact area between the sole surface 12 and the grass is increased, and upward drag (ascending force) received by the head hd from the grass is increased. Therefore, the catching is suppressed, and the head hd is likely to be slid on the surface of the grass, which provides an improvement in coming loose performance.

As described above, in the short club 4, the head hd comes in the grass surface at an acute angle (a large attack angle) with respect to the grass surface. Therefore, a hit point on the face surface 14 is apt to vary in the up-down direction, which is apt to cause the deviation of the head at an impact. The deviation is deviation involving the rotation of the head hd around an axis taken along the toe-heel direction. Since the weight distributed to the sole surface 12 is increased by increasing the sole width WSc in the short club 4, and the moment of inertia with respect to the rotation is increased, the deviation is decreased. Therefore, the launch angle of the hit ball is stabilized. As a result, the height and the flight distance of the trajectory are stabilized.

In the iron type golf club head, comparatively much weight is distributed to the hosel 16. When the weight distributed to the sole surface 12 is increased, the weight is dispersed to the hosel 16 and the sole surface 12 in the whole head hd. Since the hosel 16 and the sole surface 12 are comparatively separated from each other, the moment of inertia is increased by the mass dispersion, which suppresses the deviation caused by the variation of the hit points in the up-down direction.

[Flows of Sole Width WSt and Sole Width WSh]

In the set 2, the sole width WSt at the toe reference position Pt is increased as the loft angle is increased. In other words, in the set 2, the sole width WSt is increased as the club length is decreased. Therefore, the sole width WSt of the head hd7 (the third club) is greater than the sole width WSt of the head hd4 (the second club). The sole width WSt of the head hd4 (the second club) is greater than the sole width WSt of the head hd1 (the first club).

In the set 2, the sole width WSh at the heel reference position Ph is increased as the loft angle is increased. In other words, in the set 2, the sole width WSh is increased as the club length is decreased. Therefore, the sole width WSh of the head hd7 (the third club) is greater than the sole width WSh of the head hd4 (the second club). The sole width WSh of the head hd4 (the second club) is greater than the sole width WSh of the head hd1 (the first club).

[Effects of Flows of Sole Width WSt and Sole Width WSh (Comparatively Long Club)]

These flows further improve the effect of the flow of the sole width WSc described above. Since the rotation radius (radius of head path) of the swing is increased in the long club 4, the moving distance of the head hd while being brought into contact with the grass is increased. Therefore, in the long club 4, the resistance caused by the contact with the grass largely influences coming loose performance. By decreasing the sole widths WS on the toe and heel sides in addition to the middle portion in the long club 4, the resistance from the grass can be further reduced.

[Effects of Flows of Sole Width WSt and Sole Width WSh (Comparatively Short Club)]

These flows further improve the effect of the flow of the sole width WSc described above. Since the rotation radius (radius of head path) of the swing is decreased in the short club 4, the head hd comes in the grass surface at an acute angle (a large attack angle) with respect to the grass surface. Therefore, the head hd very deeply gets into under the grass, which is apt to cause the catching of the grass. By increasing the sole widths WS on the toe and heel sides in addition to the middle portion in the short club 4, upward drag (ascending force) received by the head hd from the grass is increased, which further suppresses the catching. As a result, the head hd is likely to be slid on the surface of the grass, which provides an improvement in coming loose performance.

[Flow of Curvature Radius of Trailing Edge E2]

In the set 2, the curvature radius of the trailing edge E2 in the planar view is increased as the loft angle is increased. In other words, the curvature radius of the trailing edge E2 in the planar view is increased as the club length is decreased. Therefore, the curvature radius of the trailing edge E2 of the head hd7 (the third club) is greater than the curvature radius of the head hd4 (the second club). The curvature radius of the trailing edge E2 of the head hd4 (the second club) is greater than the curvature radius of the head hd1 (the first club). By the flow of the curvature radius, each iron number described above is easily designed, and each of the effects is effectively achieved.

[Flows of Difference (WSt−WSc) and Difference (WSh−WSc)]

In the set 2, the difference (WSt−WSc) is decreased as the loft angle is increased. In other words, the difference (WSt−WSc) is decreased as the club length is decreased. Therefore, the difference (WSt−WSc) of the head hd7 (the third club) is smaller than the difference (WSt−WSc) of the head hd4 (the second club). The difference (WSt−WSc) of the head hd4 (the second club) is smaller than the difference (WSt−WSc) of the head hd1 (the first club). By the flow of the difference (WSt−WSc), each iron number described above is easily designed, and each of the effects is effectively achieved.

In the set 2, the difference (WSh−WSc) is decreased as the loft angle is increased. In other words, the difference (WSh−WSc) is decreased as the club length is decreased. Therefore, the difference (WSh−WSc) of the head hd7 (the third club) is smaller than the difference (WSh−WSc) of the head hd4 (the second club). The difference (WSh−WSc) of the head hd4 (the second club) is smaller than the difference (WSh−WSc) of the head hd1 (the first club). By the flow of the difference (WSh−WSc), each iron number described above is easily designed, and each of the effects is effectively achieved.

The difference (WSt−WSc) and the difference (WSh−WSc) may be a negative value.

In the embodiment described above, the sole surface 12 including the ridgeline RL has been described as an example, but the present disclosure is not limited to a form including the ridgeline RL.

The present disclosure can be applied to all iron type golf club sets. An iron type hybrid (iron type utility) golf club set in which a face surface is a plane is included in the iron type golf club set in the present application.

The above description is only illustrative and various changes can be made without departing from the scope of the present disclosure.

What is claimed is:

1. An iron type golf club set comprising two or more iron type golf clubs having loft angles different from each other, wherein:

each of the golf clubs includes a shaft, a head attached to a tip part of the shaft, and a grip attached to a rear end part of the shaft;

the head includes a sole surface and a face surface having a face line;

the sole surface includes a leading edge and a trailing edge;

the trailing edge is curved so as to project toward a face side in a planar view of the sole surface;

a sole width WSc at a middle position of the face line is increased as the loft angle is increased; and if a sole width at a toe reference position is defined as WSt, and a sole width at a heel reference position is defined as WSh, a difference (WSt−WSc) is decreased as the loft angle is increased, and a difference (WSh−WSc) is decreased as the loft angle is increased.

2. The golf club set according to claim 1, wherein:

the sole width WSt at the reference position is increased as the loft angle is increased; and the sole width WSh at the heel reference position is increased as the loft angle is increased.

3. The golf club set according to claim 1, wherein a curvature radius of the trailing edge in the planar view is increased as the loft angle is increased.

4. The golf club set according to claim 1, wherein:

the sole surface includes a ridgeline extending from a toe side toward a heel side, a leading surface extending between the ridgeline and the leading edge, and a trailing surface extending between the ridgeline and the trailing edge;

the leading surface is inclined upward toward the face side; and the trailing surface is inclined upward toward a back side.

5. The golf club set according to claim 1, wherein:

the set includes at least two selected from the group consisting of the following first club, second club and third club:

first club: a club having a loft angle of 22 degrees or greater but less than 28.5 degrees, and a club length of 37.25 inches or greater but 38.5 inches or less;

second club: a club having a loft angle of 28.5 degrees or greater but less than 36.5 degrees, and a club length of 36.25 inches or greater but less than 37.25 inches;

third club: a club having a loft angle of 36.5 degrees or greater but 47 degrees or less, and a club length of 35 inches or greater but less than 36.25 inches.

6. The golf club set according to claim 5, wherein:

the set includes the first club, the second club and the third club.

7. The golf club set according to claim 1, wherein:

the face lines include a longest face line, the position of a toe side end of the longest face line is the toe reference position, the position of a heel side end of the longest face line is the heel reference position.

8. An iron type golf club set comprising two or more iron type golf clubs having loft angles different from each other, wherein:

each of the golf clubs includes a shaft, a head attached to a tip part of the shaft, and a grip attached to a rear end part of the shaft;

the head includes a sole surface and a face surface having a face line;

the sole surface includes a leading edge and a trailing edge;

the trailing edge is curved so as to project toward a face side in a planar view of the sole surface;

a sole width WSc at a middle position of the face line is increased as the loft angle is increased; and a curvature radius of the trailing edge in the planar view is increased as the loft angle is increased.

* * * * *